US008390403B1

(12) United States Patent
Schaffner et al.

(10) Patent No.: US 8,390,403 B1
(45) Date of Patent: Mar. 5, 2013

(54) WIDEBAND RIDGED WAVEGUIDE TO DIODE DETECTOR TRANSITION

(75) Inventors: James H. Schaffner, Chatsworth, CA (US); Jonathan Lynch, Oxnard, CA (US)

(73) Assignee: HRL Laboratories, LLC, Malibu, CA (US)

( * ) Notice: Subject to any disclaimer, the term of this patent is extended or adjusted under 35 U.S.C. 154(b) by 901 days.

(21) Appl. No.: 12/359,986

(22) Filed: Jan. 26, 2009

(51) Int. Cl.
*H01P 1/00* (2006.01)
*H01Q 13/00* (2006.01)

(52) U.S. Cl. ..... 333/250; 343/786

(58) Field of Classification Search ..... 333/248, 333/250, 254, 260; 343/772, 776, 784, 786; 324/76.11, 600
See application file for complete search history.

(56) References Cited

U.S. PATENT DOCUMENTS

| | | | | |
|---|---|---|---|---|
| 3,668,554 | A | 6/1972 | Dupre | 331/107 R |
| 3,670,328 | A | 6/1972 | Mardon et al. | 342/104 |
| 3,882,396 | A | 5/1975 | Schneider | 455/325 |
| 4,157,550 | A * | 6/1979 | Reid et al. | 343/786 |
| 4,789,840 | A | 12/1988 | Albin | 329/354 |
| 5,233,464 | A | 8/1993 | Costich | 359/359 |
| 5,365,237 | A | 11/1994 | Johnson et al. | |
| 6,049,308 | A | 4/2000 | Hietala et al. | 343/700 MS |
| 6,049,313 | A * | 4/2000 | Sawada et al. | 343/786 |
| 6,417,502 | B1 | 7/2002 | Stoner et al. | |
| 6,635,907 | B1 | 10/2003 | Nguyen et al. | |
| 6,845,184 | B1 | 1/2005 | Yoshimura et al. | 385/14 |
| 7,583,074 | B1 | 9/2009 | Lynch | |
| 7,795,859 | B1 * | 9/2010 | Lynch et al. | 324/120 |
| 8,030,913 | B1 | 10/2011 | Lynch | |
| 2005/0264466 | A1 | 12/2005 | Hibino et al. | |

OTHER PUBLICATIONS

Yujiri, L., "Passive Millimeter Wave Imaging," IEEE MII-S International Microwave Symposium Digest, 2006, pp. 98-101, Jun. 2006.
Moyer, H.P. et al., "Sb-Heterostructure Low Noise W-Band Detector Diode Sensitivity Measurements," IEEE MTT.S international Microwave Symposium Digest 2006, pp, 826-829, Jun. 2006.
Moyer, H.P. et al., "Sb-Heterostructure Diode Detector W-band NEP and NEDT Optimization," Proceeding of SPIE vol. 6211, 62110J-1 (2006).
Lynch, J., et al, "Unamplified Direct Detection Sensor for Passive Millimeter Wave Imaging," Proc. of SPIE on Passive Millimeter-Wave Imaging Technology, eds. R. Appleby and D. Wikner, vol. 6211, 2006.

(Continued)

*Primary Examiner* — Dean O Takaoka
(74) *Attorney, Agent, or Firm* — Ladas & Parry

(57) ABSTRACT

A RF pick-up probe, RF choke, and DC output line that simultaneously receives RF radiation from a waveguide and provides a detected DC voltage provided by a diode RF detector disposed in said waveguide to one or more output video lines. The RF pick-up probe, RF choke, and DC output line are preferably disposed with an antenna transition element for coupling a horn antenna to a matched diode detector which provides the aforementioned DC voltage. The transition preferably includes a ridged waveguide operatively coupled to the horn antenna; a substrate for supporting a diode chip, carrying said matched diode detector, adjacent the waveguide, the substrate also supporting a pair of RF pick-up probes, each RF probe having a portion which is coupled with the diode chip, the substrate also supporting conductors coupled to the diode chip and to the pair of RF pick-up probes; and a waveguide short circuit at least partially enclosing the diode chip and disposed adjacent the substrate.

22 Claims, 13 Drawing Sheets

OTHER PUBLICATIONS

Hesler, J.L., et al., "Development of Compact Broadband Receivers at Submillimeter Wavelengths," IEEE Aerospace Conference Proceedings, pp. 735-740 (2004).
Virk, R.S., et al, "A Lowcost W-band MIC Mixer using Flip-Chip Technology," IEEE Microwave and Guided Wave Letters, vol. 7, No. 9, Sep. 1997, pp. 294-296.
U.S. Appl. No. 11/303,642, filed Dec. 2005, Lynch, et al.
U.S. Appl. No. 12/172,481, filed Jul. 2008, Lynch, Jonathan J.
Kusamitsu, H., et al., "The Flip-Chip Bump Interconnection for Millimeter-Wave GaAs MMIC", IEEE Trans. on Electronics Packaging Manufacturing, vol. 22, No. 1, Jan. 1999, pp. 23-28.
Ramo, S., et al., "Fields and Waves in Communication Electronics," 1st edition, John Wiley and Sons, 1965, pp. 465-467.
Lange, et al., "Development of a 3×3 Micromachined Millimeter Wave SIS Imaging Array," IEEE Trans. on Applied Superconductivity, vol. 7, No, 2., Jun. 1997.
Arttu Luukanen, Aaron J. Miller, and Erich N. Grossman, "Active Millimeter-wave Video Rate Imaging With a Staring 120- element Microbolometer Array," Proc. SPIE Int. Soc. Opt. Eng. 5410,195 (2004).
Siegel, P., "Terahertz Technology," IEEE Trans. on Microwave Theory and Techniques, vol. 50, No. 3, Mar. 2002.
"Thin Film Products Guideline," American Technical Ceramics at www.atceramics.com/products/thinfilm.asp. Printed from internet on May 1, 2009.

* cited by examiner

WIDEBAND RIDGED WAVEGUIDE TO DIODE DETECTOR TRANSITION

STATEMENT OF GOVERNMENT INTEREST

The US Government has a paid up license in this invention and the right in limited circumstances to require the patent owner to license others on reasonable terms as provided for by the terms of W911QX-04-C-0127 awarded by DARPA.

CROSS REFERENCE TO RELATED APPLICATIONS

This application is related to the disclosure of U.S. patent application Ser. No. 12/172,481 filed 14 Jul. 2008, the disclosure of which is hereby incorporated herein by this reference.

TECHNICAL FIELD

This invention relates to passive imaging technologies where detectors rely on ambient millimeter wave radiation naturally radiated by an object to detect its presence. The present invention may be used to couple an antenna, such as a horn antenna, directly to a detector diode without the need for intermediate pre-amplification. The detectors may be arranged in a two dimensional array.

BACKGROUND

Millimeter wave imaging technology, particularly at frequencies from about 70-150 GHz, is actively being pursued for concealed weapons detection, all-weather landing aids, and imaging of building interiors. Passive imaging, where no active source is used (such as compared to radar technologies), has the advantage of not requiring a transmitter thus reducing the cost of the system. It relies on detection of the various levels of millimeter wave radiation naturally radiated by an object (that is its' emissivity) to differentiate between the object and its' background. Detection can be direct to a DC voltage which is proportional to the received integrated noise power, or else the received noise can be mixed down to a lower frequency and then detected. Direct detection has the advantage that it requires fewer parts, but the very small millimeter wave noise levels before detection generally require amplification (see L. Yujiri, "Passive Millimeter Wave Imaging," IEEE MTT-S International Microwave Symposium Digest, 2006, pp. 98-101, June 2006). HRL Laboratories of Malibu, Calif. has developed a Sb-heterostructure diode that has been optimized to operate as a direct detector without bias voltage (see H. P. Moyer, R. L. Bowen, J. N. Schulman, D. H. Chow, S. Thomas, J. J. Lynch, and K. S. Holabird, "Sb-Heterstructure Low Noise W-Band Detector Diode Sensitivity Measurements," IEEE MTT-S international Microwave Symposium Digest 2006, pp, 826-829, June 2006). Thus, direct detection without pre-amplification is possible (see J. Lynch, H. Moyer, J. Schulman, P. Lawyer, R. Bowen, J. Schaffner, D. Choudhury, J. Foschaar, and D. Chow, "Unamplified Direct Detection Sensor for Passive Millimeter Wave Imaging," Proc. Of SPIE on Passive Millimeter-Wave Imaging Technology, eds. R. Appleby and D. Wilkner, Vol. 6211, 2006), which could enable a low-cost millimeter wave focal plane array if a suitable means for coupling an arrayable antenna to an array of the aforementioned Sb-heterostructure diodes could be devised. The present disclosure is directed to techniques for coupling an antenna, such as a horn antenna, to a diode without the need for intermediate pre-amplification.

FIGS. 1A-1C shows an initial effort at a solution to this problem. FIG. 1A shows a top the basic concept of a low-cost millimeter wave passive imaging array. Only two antennas are shown in this view for ease of illustration, but the array, which you typically be a two dimensional array, can be of any size desired. FIG. 1B is a side sectional view, the section being taken along line 1B-1B shown in FIG. 1A. In order to make the device shown in FIGS. 1A and 1B, diode chips 1 are mounted onto a printed circuit board 2 preferably using a flip-chip attachment process. The printed circuit board 2 has a conductive bottom surface 4*a* typically formed of a metal such as copper. The top surface of the printed circuit board 2 is patterned so that wiring 4*c* is formed by pattering the typical metallic surface of the printed circuit board 2. The wiring 4*c* on the top surface can be seen in FIG. 2A. Vias 4*b* conduct RF energy from the diode chip 1 and through the printed circuit board 2 to the bottom side thereof. A molded metal horn array 3 is soldered onto the topside wiring 4*c* on circuit board 2 preferably for efficient W-band image noise collection. FIG. 1C is a close up view of a diode chip 1, which has a pair of diodes 5*a*, 5*b*. The conductors 4*d* coupled respectively to diodes 5*a* and 5*b* pass each other without making electrical contact with each other in region 7 so as to make contact with the connectors 8 shown on opposite edges of chip 1. A thin layer of an insulator 6 allows the wiring from the diodes 5*a*, 5*b* to pass other each other with making connection. The connectors 8 can be bonded to the wiring 4*c* on the circuit board 2 using flip-chip bonding techniques known in the art.

While there are some common features between these initial efforts and the technology described subsequently herein, the present disclosure addresses some shortcomings of the this initial effort. In particular, the original diode chip 1 had RF pick-up antennas on the diode chip 1. It was subsequently discovered through electromagnetic simulation that the RF pick-up antennas needed to be on a printed circuit board substrate for wide band operation. Also, a back-short tuning cavity was fabricated using the printed circuit board itself, whereas in the present disclosure, an air-filled back-short cavity is explicitly made and used for increased operational bandwidth. The other major difference in these initial efforts is that the video output for a particular input polarization is single-ended, whereas in the present disclosure a differential output is described that can reduce interference on the DC lines, although for single linearly polarized field.

FIGS. 2A-2D shows a prior art (see J. Lynch, et. al., "Unamplified Direct Detection Sensor for Passive Millimeter Wave Imaging." *Proc. of SPIE on Passive Millimeter-Wave Imaging Technology*, eds. R. Appleby and D. Wilkner, Vol. 6211, 2006) passive millimeter wave imaging transition that this invention improves upon. It can be seen in the plan view of FIG. 2A and the perspective view of FIG. 2B that the diode chip 1 is flip-chip mounted onto a fused silica substrate 2 that forms part of the back-short cavity. The video output 4 is taken off of the chip with a coplanar strips (ground-signal-ground) transmission line that is orthogonal to the RF pick-up antennas. The DC signal line is then bonded to a coaxial centerline pin/conductor. FIG. 2C shows a close view of the chip 1, while FIG. 2D is a bottom view of the chip 1 showing connections to conductors disposed on the substrate 2.

The new technology described in this disclosure integrates an RF choke into the RF pick-up probes (antennas) so that the DC lines can come directly off of the probe. This eliminates a lot of excess metal within the transition that causes parasitic reactance and DC/RF isolation in the DC lines. Also, the use of an air-filled back-short cavity of this disclosure rather than a fused silica filled cavity enables broader bandwidths to be achieved.

BRIEF DESCRIPTION OF THE DISCLOSURE

This disclosure teaches how to make a very wide-band millimeter wave transition from a ridged waveguide input to a millimeter wave imaging diode detector. This transition is designed for operation from 70 GHz to greater than 140 GHz. Novel features of this disclosure are believed to include:

- A wide-band transition that takes an input millimeter wave signal from ridged waveguide to a millimeter wave impedance matched diode detector chip.
- An integrated RF pick-up probe, RF choke, and DC output line that simultaneously receives millimeter wave radiation from a waveguide and provides the detected DC voltage the millimeter wave diode detector to an output video line.
- A differential DC output with high RF isolation.
- A substrate with the integrated transition contained within unit cell of a passive millimeter wave detector array that enables the array to be scalable to any size.
- A method of using a fused silica substrate and standard thin film processing techniques to create the transition.
- A method of using an alumina substrate and standard thin film processing techniques to create the transition.
- By carefully integrating the antenna transition elements and the detector, the conventional requirement for a Low Noise Amplifier (LNA) is eliminated.

The transition is designed to couple to a ridged waveguide which is know in the art to have a wider bandwidth than a standard rectangular waveguide (for coupling to the pick-up horn antenna).

The DC output lines come directly off of the RF pick-up probes, thus minimizing parasitic RF pick-up by the DC line and facilitating a differential DC output.

This invention has improved RF isolation from the DC line due to the RF choke and a cut-off DC output waveguide channel.

Two embodiments are described below, one for fused silica and one for alumina. Alumina substrates are not typically used at frequencies 70 GHz+.

In one aspect the present invention provides a transition for coupling a horn antenna to a matched diode detector. The transition preferably comprises a ridged waveguide operatively coupled to the horn antenna; a substrate for supporting a diode chip (carrying the matched diode detector) adjacent the waveguide, the substrate also supporting a pair of RF pick-up probes, each RF probe having a portion which is coupled with the diode chip; and a waveguide short circuit at least partially enclosing the diode chip and disposed adjacent said substrate.

In another aspect the present invention provides a combination of a RF pick-up probe, RF choke, and DC output line that simultaneously receives RF radiation from a waveguide and provides a detected DC voltage provided by a diode RF detector disposed in said waveguide to one or more output video lines via the RF choke.

DETAILED DESCRIPTION

Figure 1A:
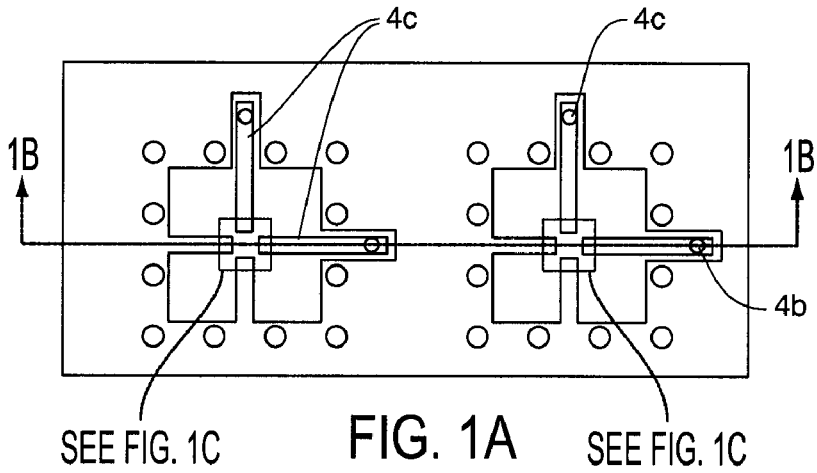
FIGS. 1A-1C shows some initial efforts at a solution to the problem of coupling an antenna, such as a horn antenna, to a diode without the need for intermediate pre-amplification.
Figure 1B:
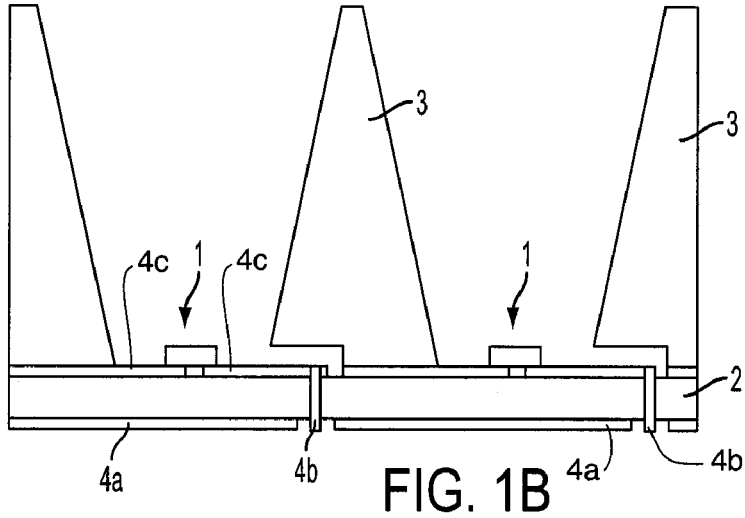
Figure 1C:
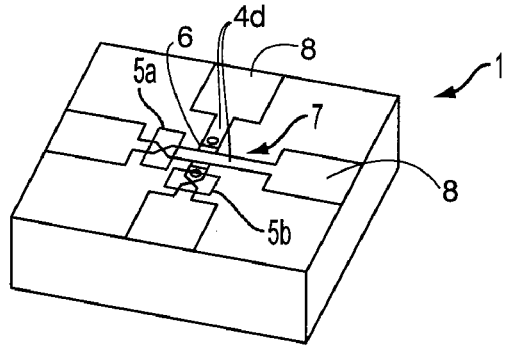
Figure 2B:
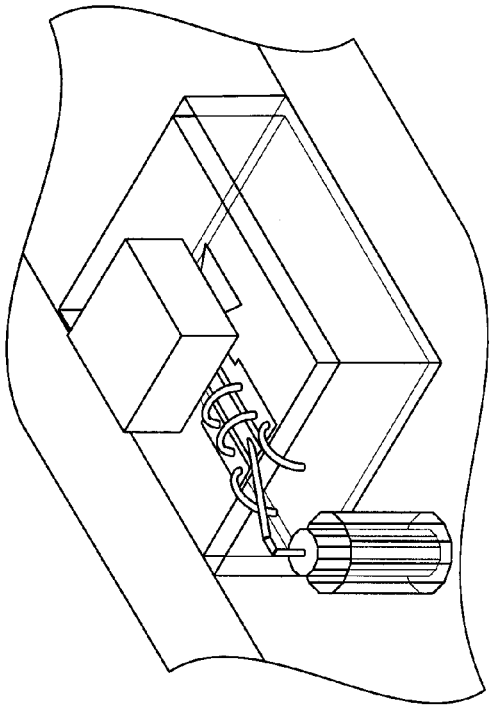
FIG. 2B PRIOR ART
FIGS. 2A-2D show a prior art passive millimeter wave imaging transition (see J. Lynch, et. al., "Unamplified Direct Detection Sensor for Passive Millimeter Wave Imaging." *Proc. of SPIE on Passive Millimeter-Wave Imaging Technology*, eds. R. Appleby and D. Wilkner, Vol. 6211, 2006)
Figure 2D:
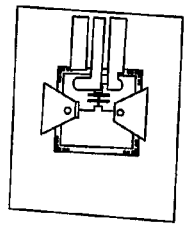
FIG. 2D PRIOR ART
Figure 2C:
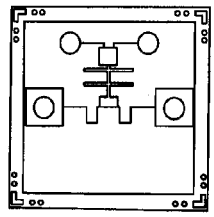
FIG. 2C PRIOR ART
Figure 2A:
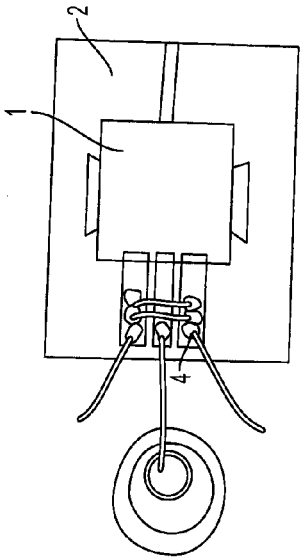
FIG. 2A PRIOR ART
Figure 3A:
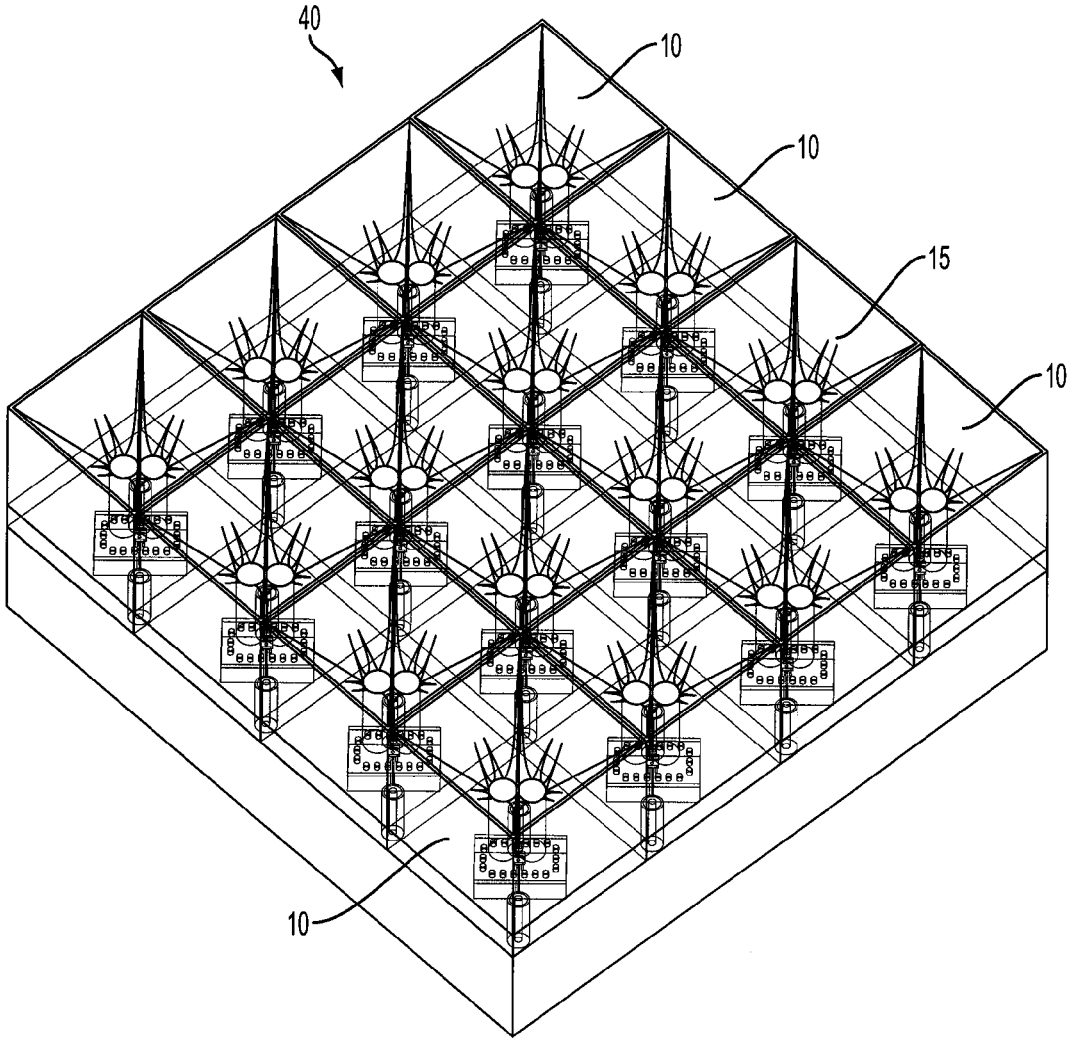
FIG. 3A depicts a focal plane array of individual pixels elements of a type shown in FIG. 3B, for example.
Figure 3B:
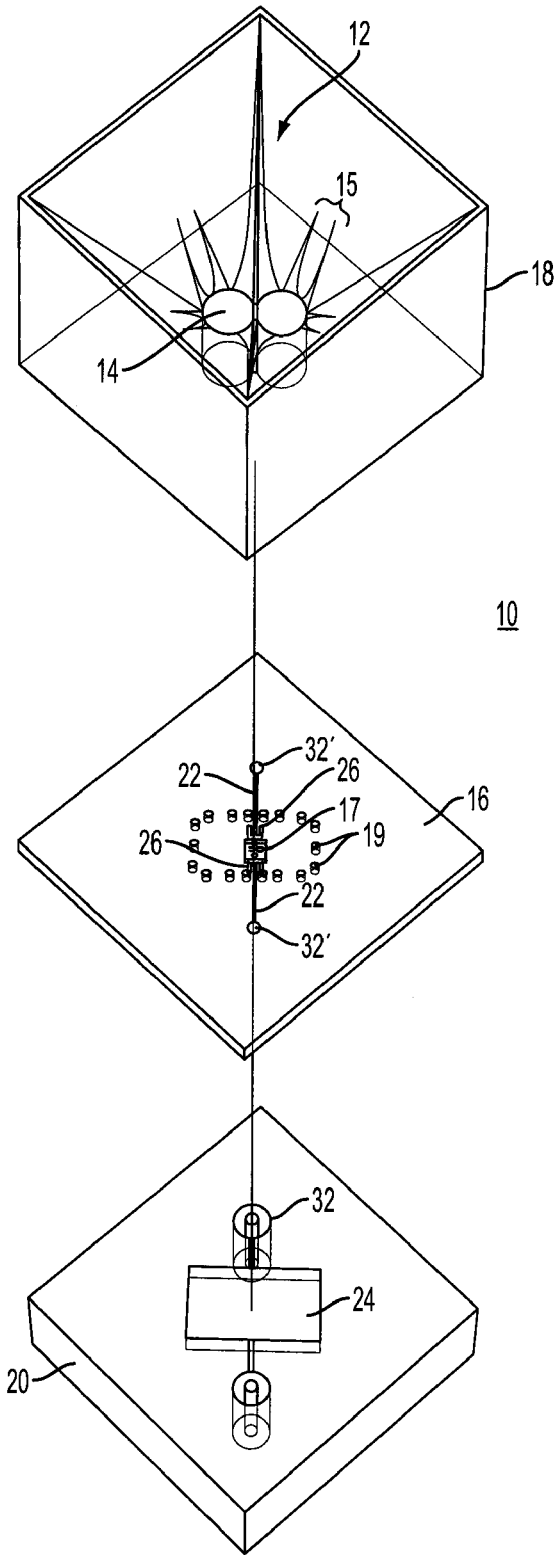
FIG. 3B is an exploded view of an individual passive millimeter wave imaging pixel that uses the wideband transition disclosed herein and which may be grouped in an array as depicted by FIG. 3A.

An exploded system level view of a passive millimeter wave imaging pixel 10 that utilizes the transition disclosed herein is shown in FIG. 3B. This pixel can be replicated in a periodic fashion in two directions to create a two dimensional array of pixels 10 as shown by FIG. 3A. The array of pixels 10 may be a planar array as shown in FIG. 3B or it may conform to a non-planar shape and hence a surface defined by the leading surfaces of the pixels 10 may assume a three dimensional shape.

As can be seen in FIG. 3B, each pixel 10 preferably comprises three basic parts:

(1) a horn antenna 12 that collects incoming millimeter wave energy and transitions the incoming electromagnetic fields from free-space to a ridged waveguide 14. The horn antenna 12 is depicted in an exploded perspective in the upper portion FIG. 3B and greater detail in FIGS. 4C and 4D which present a top down view and a cross sectional view, respectively, of the horn antenna 12. The sectional view of FIG. 4D is taken along lines 4D-4D shown in FIG. 4C. The horn antenna 12 is preferably formed from a block 18 of electrically conductive material such as a metal. Lines 15 represent small indentations which may (or may not) occur on the interior walls of the horn antenna 12 as a byproduct of machining the horn antenna from a block of metallic material. These indentations 15 do not seem to affect the RF performance of the antenna 12 in any appreciable way and therefor the indentations may be omitted. The block 18 has the horn antenna 12 formed at one end thereof and a ridged waveguide 14 coupled to a distal end or throat of the horn antenna 12.

Figure 4A:
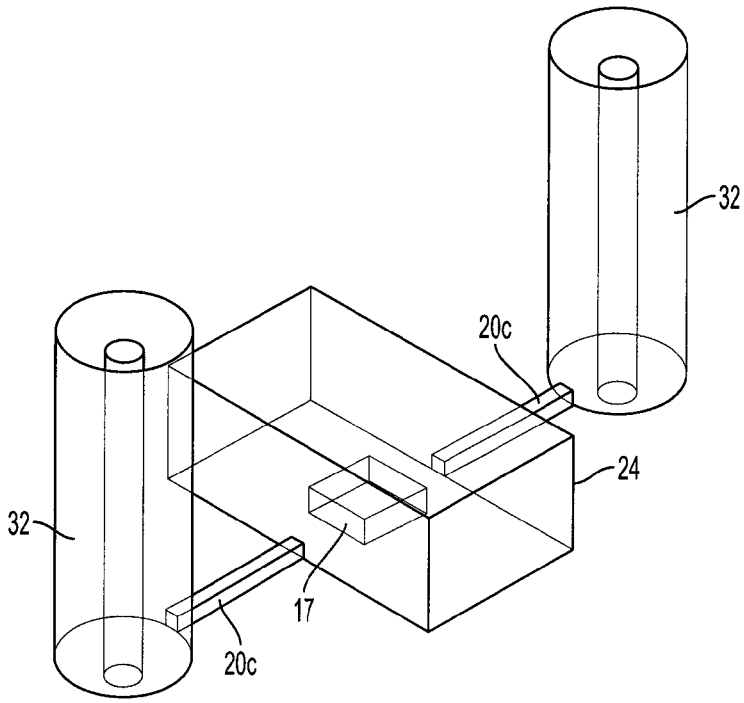
FIG. 4A depicts the preferred internal arrangement, in a perspective view, of the cavity and differential video signal output coaxial lines arranged in the block 20 shown in FIG. 3B.

(2) a transition substrate 16 preferably contains a detector diode chip 17, RF pick-up probes 26 which receive millimeter wave energy from the ridged waveguide 14 and brings it to the detector chip 17 via conductors 26*c*, and differential DC video lines 22 for carrying a rectified millimeter wave signal to pads 32' which are coupled to the center conductor of coaxial lines 32 depicted in FIG. 4A. The detector diode chip 17 is preferably flip-chip bonded to conductors on the transition substrate 16. The transition substrate 16 is depicted in perspective in the middle portion of FIG. 3B and greater detail in a perspective view of FIG. 4B. It ends up being sandwiched between block 18 and a block 20. The transition substrate 16 is preferably formed of a dielectric material, such as fused silica (quartz), alumina, liquid crystal polymer or any other suitably rigid material preferably having a millimeter wave loss tangent less than 0.01.

(3) a pixel back structure formed by a electrically conductive block 20 with an cavity 24 therein that forms a waveguide tuning short circuit. The block 20 also has differential video signal output coaxial lines 32 for connection to post processing electronics (not shown). The pixel back structure 20 may be formed of a metal and is depicted in perspective view in the lower portion of FIG. 3B and its preferred internal arrangement is depicted in greater detail in a perspective view of FIG. 4A. In order to simply FIG. 4A, this figure shows the internal structure of the block 20 without showing its external shape or configuration, as its external shape or configuration is of less importance than its internal shape or configuration. This figure also shows that the detector chip 17 is received in cavity 24 when the transition substrate 16 is positioned adjacent block 20. FIG. 4A also shows the two co-axial transmission lines 32 whose center conductors are each coupled to an associated pad 32' shown in FIG. 4B. Pads 32' mate with conductors 22 as shown. The exterior shields of the two co-axial transmission lines 32 are preferably formed by the body of block 20, which is preferably metallic. The two co-axial transmission lines 32 completely penetrate block 20 for connection to the aforementioned post processing electronics, while the cavity 24 does not penetrate the depth of block 20 and thus is open on one side of block 20 for receiving the detector chip 17 as already mentioned. The space between the coaxial transmission lines 32 to the block 20 may be filled with a dielectric material as is common with coaxial cables.

The size of the cavity 24 may be bigger than needed to just accommodate the detector chip 17. The cavity 24 preferably acts as a short circuit at the frequencies of interest to the antenna. It can be best sized using software such as Ansoft HFSS® to simulate the transition 10.

This pixel 10 can be part of a larger array, such as that depicted by FIG. 3A, which would typically be located at the focus of an optical lens or reflector system as part of a millimeter wave imaging camera, for example. An exemplary the use of the millimeter wave pixels 10 described herein is in a two dimensional focal plane array 40 of pixels 10 as shown in FIG. 3A. The blocks 18 forming the horn antenna 12 and ridged waveguide 14 may be formed as one larger integral block when formed in an array such as that described with reference to FIG. 3A. Similarly, blocks 20 and insulating substrates 16 make likewise be formed as larger electrically conductive block and a larger insulating sheet when disposing a plurality of pixels in an array.

Figure 4B:
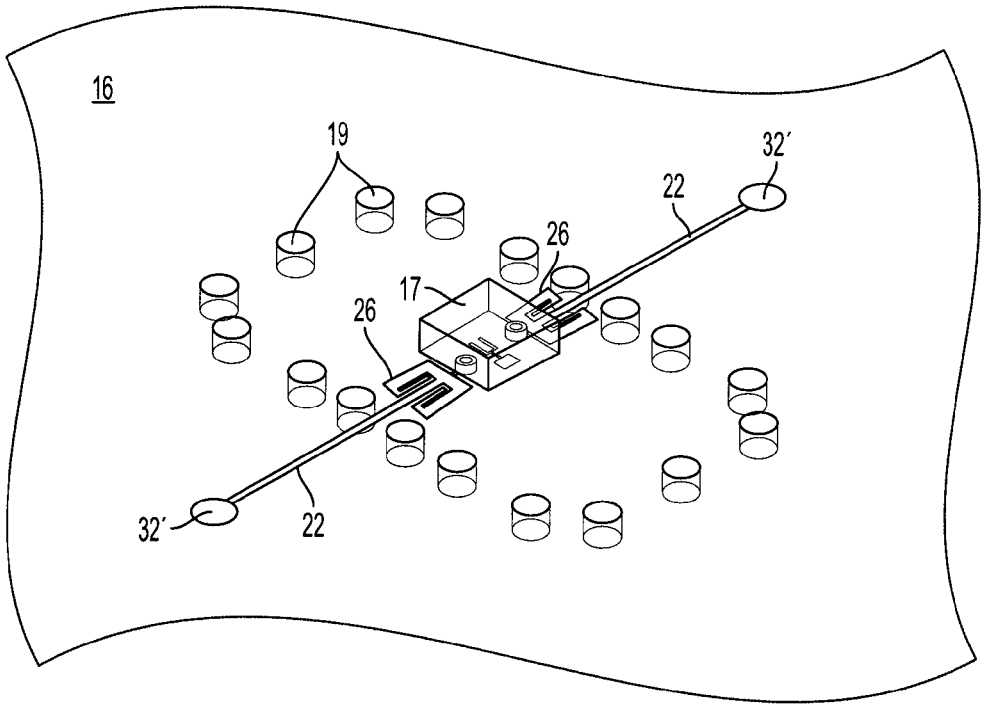
FIG. 4B depicts one embodiment of the substrate 16 also shown in FIG. 3B and also in a perspective view—this figure depicts the elements disposed on and in it in greater detail than done in FIG. 3B.
Figure 4C:
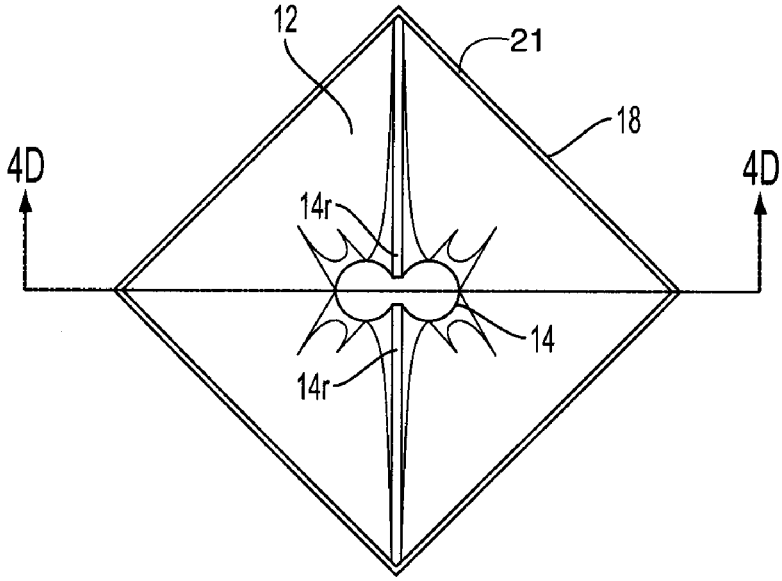
FIG. 4C a top view of block 18 also shown in FIG. 3B.
Figure 4D:
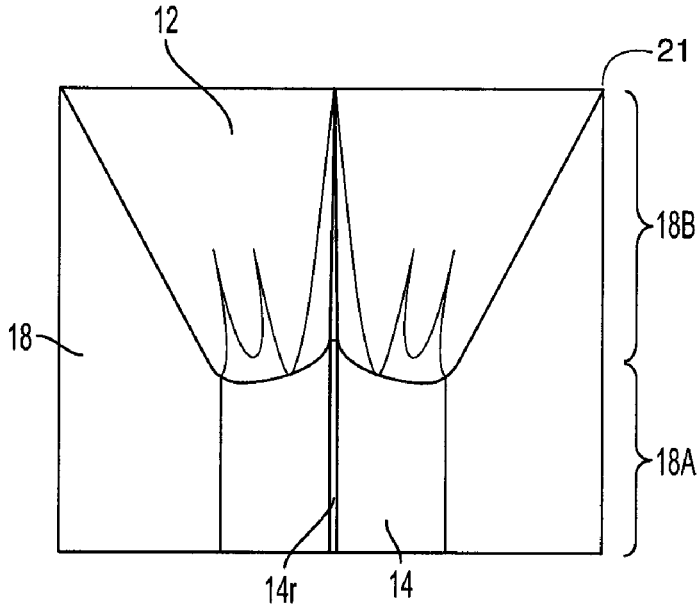
FIG. 4D is a side elevational view taken along section line 4D-4D of FIG. 4C showing the internal arrangement of the waveguide and the horn antenna.
Figure 5B:
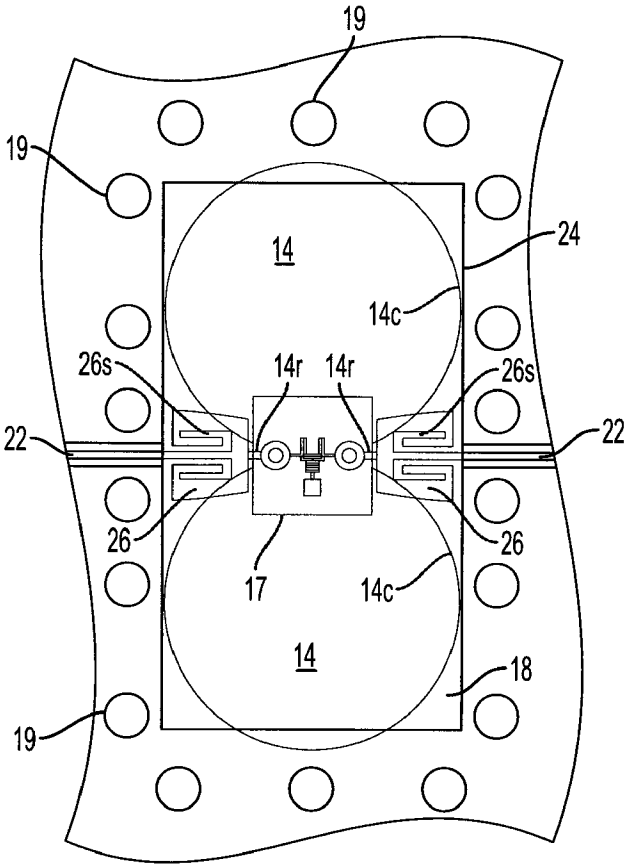
FIG. 5A is a perspective view and FIG. 5B is top view of one embodiment of the transition of the present disclosure.
Figure 5A:
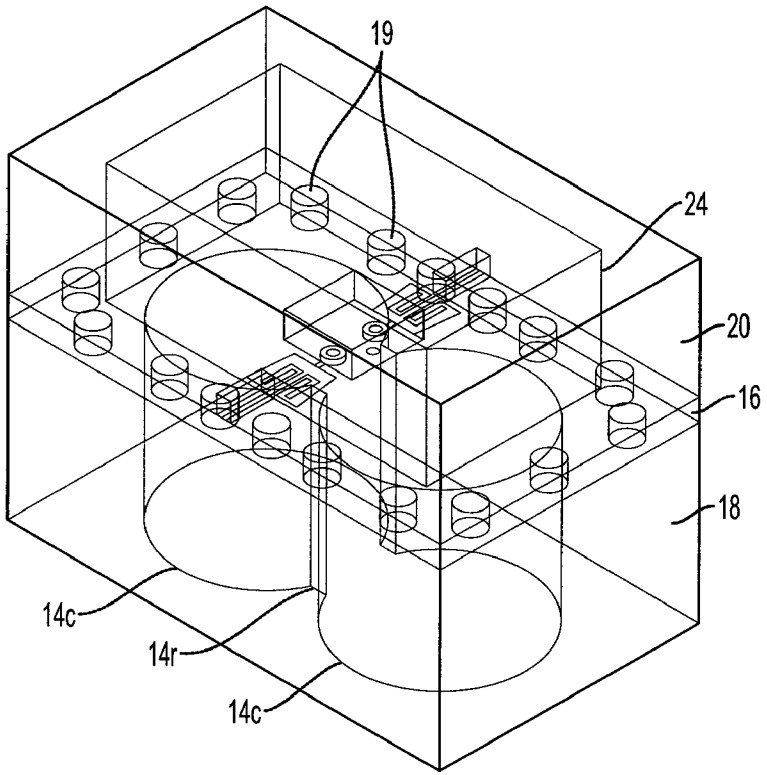

FIG. 5A is a perspective view and FIG. 5B is top down view of one embodiment of the transition of the present disclosure. The horn portion 18B of block 18 (see FIG. 4D) is not shown in these figures for ease of illustration. These figures in combination with FIGS. 4C and 4D provide a close-up view of the region of the pixel 10 that includes the ridged waveguide 14 that connects to the horn antenna 12 in the horn portion 18B of block 18. Also not shown in these figures, for ease of illustration, are the video output connection pads 32' and the video output coaxial lines 32 shown in FIGS. 4A and 4B, for example. In this embodiment substrate 16 is preferably formed of 0.125 mm thick fused silica disposed between two electrically conductive plates or blocks 18 and 20 which may be made of a metal such as aluminum, copper or brass. The diode detector chip 17 is preferably flip-chip bonded onto the fused silica substrate 16 preferably using known techniques such as those disclosed by Virk, R. S.; Maas, S. A.; Case, M. G.; Matloubian, M.; Lawyer, P.; Sun, H. C.; Ngo, C.; Rensch, D. B. in "A lowcost W-band MIC mixer using flip-chip technology", *IEEE Microwave and Guided Wave Letters*, Vol. 7, No. 9, September 1997, pp. 294-496 or by H. Kusamitsu, Y. Morishita, K. Maruhashi, M. Ito, and K. Ohata in "The Flip-Chip Bump Interconnection for Millimeter-Wave GaAs MMIC", *IEEE Trans. On Electronics Packaging Manufacturing*, vol. 22, No. 1, January 1999, pp. 23-28. The disclosures of these documents is hereby incorporated herein by reference.

Other dielectric materials than fused silica may be used for the substrate 16 which supports detector chip and its associated conductors 22 and RF probes 26. As will be seen, openings may be placed in substrate 16 in order to accommodate different dielectric constants of the substrate 16 when different insulating materials are used.

The horn antenna 12 is preferably formed in electrically conductive plate or block 18 as shown in FIGS. 4C and 4D, but FIG. 5A only shows the ridged waveguide portion 18A of block 18 and not the horn antenna portion 18B of block 18 for ease of illustration. FIGS. 5A and 5B are also drawn as if the depicted structure were transparent for ease of illustration and understanding the internal structures of and adjacent waveguide 14. A ridge 14*r* preferably occurs in the waveguide 14 on either side thereof projecting in an inwardly direction as can perhaps be best seen in FIG. 4C so that the throat of the waveguide 14 preferably assumes what might be called a figure eight configuration. The ridge 14*r* may extend all the way up the horn antenna with a more or less constant width as shown in FIG. 4C as opposed to decreasing to a knife edge as shown in FIG. 4D. Likewise, the edge 21 of the horn antenna 12 may decrease to a knife edge as also shown in FIG. 4D or it may have a flatten surface as shown in FIG. 4C.

Figure 6:
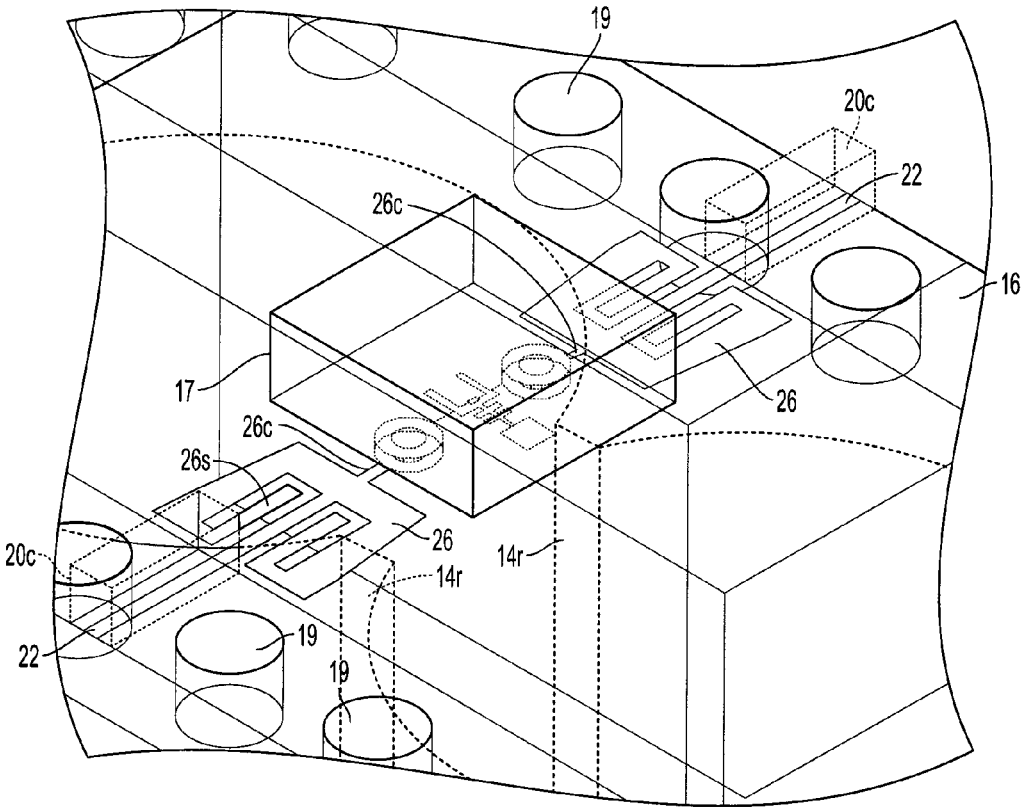
FIG. 6 is a perspective close-up view of the detector chip of FIGS. 5A and 5B mounted on a first embodiment of the substrate.

A perspective close-up view of the detector chip 17 mounted on the substrate 16 is shown in FIG. 6. In this figure, the detector chip 17 and those portions of the elements on and in layer 16 are drawn in solid lines, while elements in or on the underside of chip 17 or hidden by layer 16 are shown in dotted or dashed lines. For the most part, block 20 is omitted, but openings 20*c* forming channels in block 20 are shown, and in dashed lines, to show their arrangement relative to conductors 22 defined on substrate 16.

The detector chip 17 may have monolithic delay line inductors and silicon nitride capacitors (shown in dashed lines on FIG. 6) for impedance matching of the detector diode in chip 17 to the transmission line 32 and the aforementioned post processing electronics. The monolithic matching circuit for the diode in chip 17 is preferably of the type disclosed in related U.S. patent application Ser. No. 12/172,481. For a particular diode chip 17, the dimensions of the transition are preferably determined simultaneously with the dimensions of the MMIC tuning elements on the chip 17 in order to create an impedance match from the horn antenna input to the diode in the detector chip 17.

The transition shown in FIGS. 5A and 5B preferably uses the following distributed tuning features to achieve a wide-band impedance matched transformation from the horn antenna 12 to the diode in chip 17. First, the ridged waveguide 14 is formed in metal plate or block 18. The ridged waveguide 14 is used to expand the bandwidth over what is available for a rectangular waveguide by decreasing the cut-off frequency of the waveguide (see S. Ramo, J. R. Whinnery, and T. Van Duzer, "Field and Waves in Communications Electronics," 1st edition, John Wiley and Sons, 1965, pp. 465-467). In FIGS. 5A and 5B, the ridged waveguide 14 is defined by two intersecting cylinders 14*c* (although other geometric shapes could be used) formed in a metal plate or block 18, the cylinders 14*c* intersecting each other to help to define ridges 14*r*. The ridges 14*r* are elongated flat surfaces formed between the two cylinders (or other geometric shapes) near where they intersect. The two elongated flat surfaces 14*r* in the throat of the waveguide 14 are each disposed parallel to, but spaced from, a plane intersecting the centers of the two cylinders 14*c*. The two intersecting cylinders 14*c* form a "figure eight" configuration in with waveguide 14.

The operational frequency of the input signal to a pixel 10 and the bandwidth of the input signal to a pixel 10 as well as its impedance match to the RF pick-up probes 26 on the fused silica substrate 16 are controlled by the dimensions of the ridged waveguide 14. The maximum bandwidth of the input signal to pixel 10 is constrained on the lower frequency end by the cutoff frequency of the ridged waveguide 12*r* and on the higher frequency end by the cutoff frequency of the next order mode (which is typically the second order mode). The reason for limiting the higher frequency end of the bandwidth is that otherwise going into the next (typically second) order mode would allow energy from a direction away from the imaged target to enter the pixel 10.

For the particular embodiment shown in FIGS. 5A and 5B, the cylinder 14*c* radii are preferably 0.5 mm and their center-line-to-centerline distance is preferably maintained at 1.0 mm. A preferably 0.4 mm gap forms the ridges 14*r* which are located in-between the cylinders 14*c* on opposing sides of the waveguide 14 facing one another. This approach to creating ridged waveguide 14 in electrically conductive plate or block 18 should facilitate machining of the ridged waveguide 14 with standard metal working tools when block or plate 18 is made of a metal. Alternatively, block 18 and 20 could be injection molded out of a plastic material and then metal coated—see the related copending U.S. Patent application referred to above. Second, a waveguide cavity 24 is also used to help tune the transition to the detector diode chip 17. Waveguide cavity 24 is formed in electrically conductive plate or block 20. For the particular embodiment of FIGS. 5A and 5B, the waveguide cavity 24 dimensions are preferably 1.85 mm×1.0 mm×0.7 mm. Finally, the fused silica substrate 16 is disposed between the electrically conductive plate or block 18 containing the ridged waveguide 14 and the electrically conductive plate or block 20 containing the back-short waveguide cavity 24. In order to prevent RF losses by parallel plate electromagnetic modes within the substrate 16, conductive via posts 19 are preferably located around the cavity/ridged waveguide. These conductive via posts 19 may be fabricated using known thin film processing techniques (see, for example American Technical Ceramics "Thin Film Products Guideline," at www.atceramics.com/products/thinfilm.asp).

The arrangement and design of the detector diode chip 17 is depicted and described in greater detail in the above-mentioned U.S. patent application Ser. No. 12/172,481 filed 14 Jul. 2008. The diode attachment and RF probe metallization of the detector diode chip 17 is disposed on the side of the substrate 16 facing the back-short cavity 25. No metal RF signal connection is needed from the side of the substrate 16 attached to the ridged waveguide 14 to the side of the substrate 16 attached to the back-metal cavity 24. Posts 19 tie the ground planes on both sides of the substrate and prevent spurious substrate modes. The details of the RF probes 26 of this embodiment is best shown in FIGS. 5B and 6. The two RF probes 26 are disposed symmetrically on the substrate 16 and receive the millimeter wave signal from the ridged waveguide 14 and also serve as differential terminals for the video output lines 22. In the related U.S. Patent Application referred to above, the video lines come off a capacitor on the chip 17. The technique shown here improves the bandwidth of the antenna. The dimensions of each RF probe 26 are adjusted for the optimum impedance match looking in from the ridged waveguide 16—this adjustment can be made using software such as Ansoft HFSS® to simulate the transition 10. Each probe 26 in this embodiment is preferably 0.265 mm long, 0.25 mm wide near the chip 17, and 0.3 mm wide near the edge of cavity 24. Slots 26*s* cut into each probe 26 form a short slotted transmission line that serves as an RF choke. The length of the slotted line is optimized for maximum isolation between the RF and video signals along the video output lines 22 preferably by using the simulation software noted above. The video output signal supplied to lines 22 originates on the diode chip 17 (see FIG. 6) and is transmitted on conductors 26*c* and via the probes 26 and thence to the video output connection pads 32' via conductors 22, as shown in FIG. 4B. Conductors 22 are preferably arranged to pass through the back-side block 20 using channels 20*c* (see FIGS. 4A and 6) cut or otherwise formed in the back-side block 20. The video lines 32 are preferably 0.025 mm wide and the channel 20*c* dimensions in the back metal block 20 are preferably 0.08 mm×0.1 mm. This channel 20*c* is preferably sized to be too small for the millimeter wave signal of interest to propagate therethrough and therefore contributes to the RF isolation of the video output lines 22, yet each channel 20*c* is big enough to accommodate one of the conductors 22.

Figure 7A:
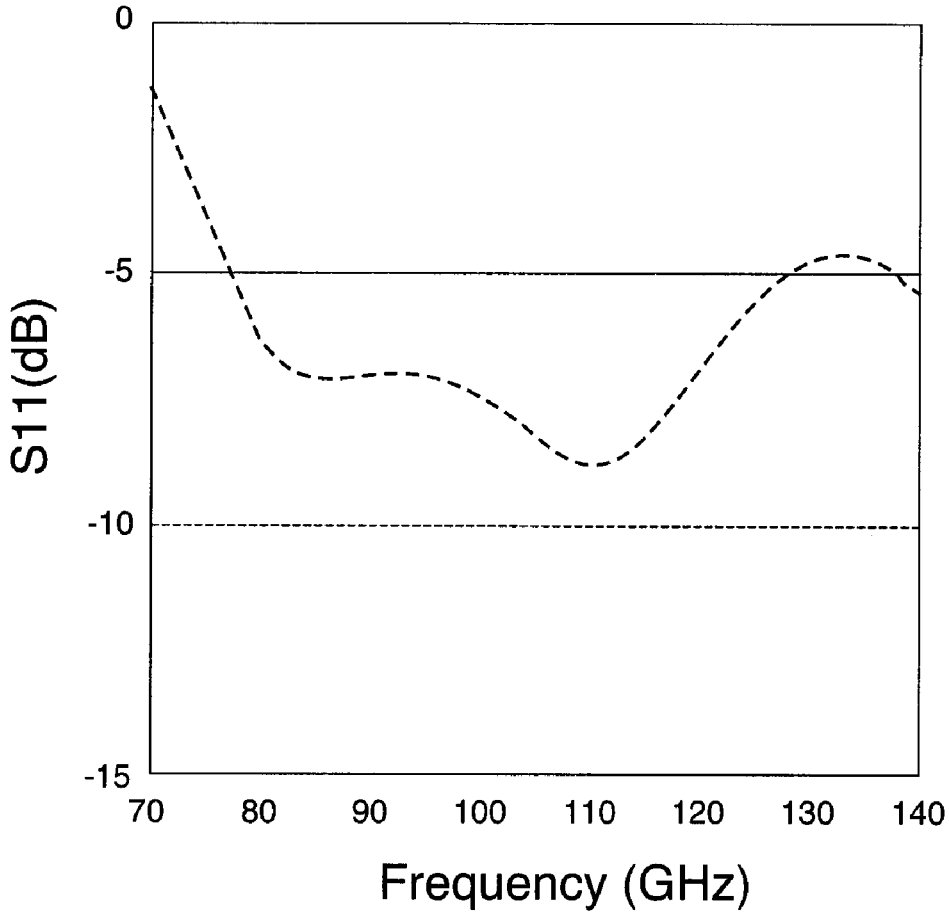
FIG. 7*a* is a graph of reflection from the transition looking in from the waveguide according to a simulation of the first embodiment.
Figure 7B:
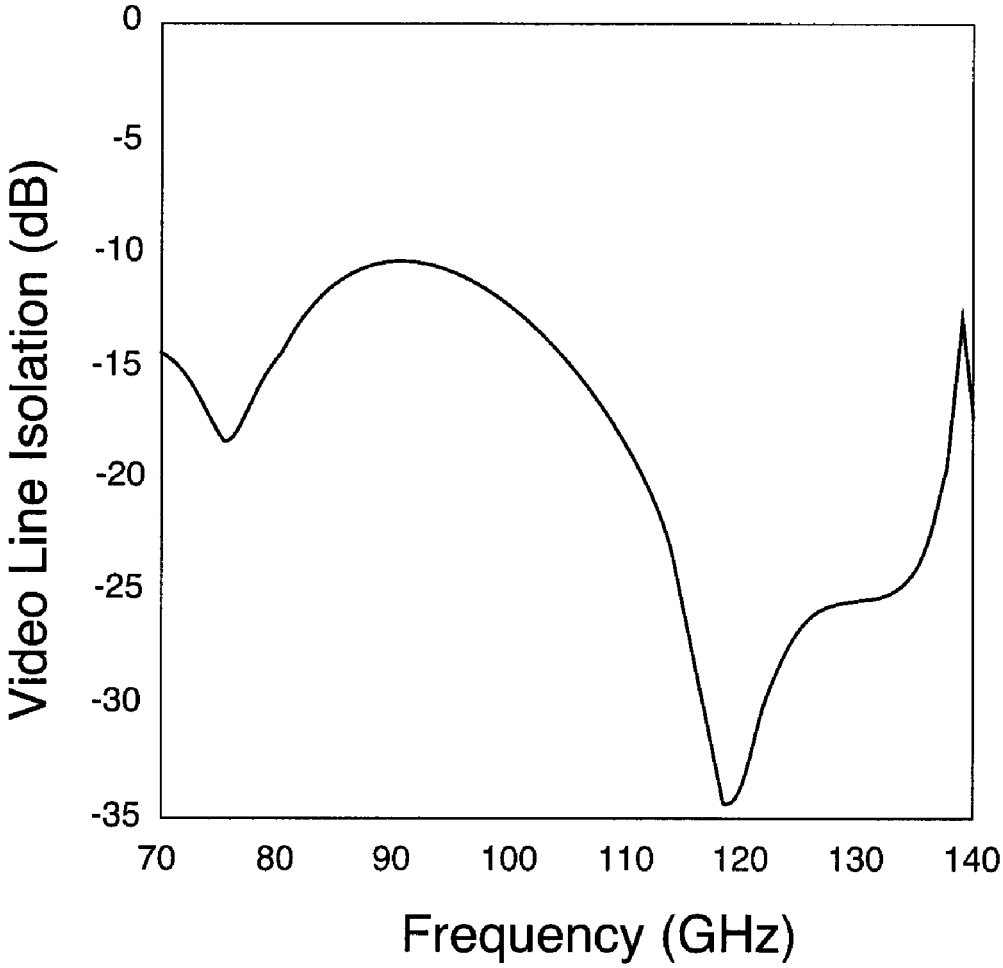
FIG. 7*b* is a graph of the RF isolation from the video output line according to a simulation of the first embodiment.

This structure was simulated using Ansoft HFSS® for a Sb-heterostructure diode in chip 17 that was 0.8 μm×0.8 μm in diameter (see the above-mentioned U.S. patent application Ser. No. 12/172,481 filed 14 Jul. 2008). The reflection from the transition 10 looking in from the waveguide is shown in the graph of FIG. 7*a*, and the RF isolation from the video output line is shown in the graph of FIG. 7*b*. The −5 dB bandwidth is 45 GHz, and an effective bandwidth (see J. Lynch, H. Moyer, J. Schulman, P. Lawyer, R. Bowen, J. Schaffner, D. Choudhury, J. Foschaar, and D. Chow, "Unamplified Direct Detection Sensor for Passive Millimeter Wave Imaging," Proc. Of SPIE on Passive Millimeter-Wave Imaging Technology, eds. R. Appleby and D. Wilkner, Vol. 6211, 2006) of 68.4 GHz for an average detector sensitivity of about 7000 V/W over the frequency band from 70 GHz to 140 GHz. The diode was modeled as a parallel combination of junction resistance of 1300Ω and junction capacitance of 8 fF. A parasitic series resistance was also included in the diode model of 25Ω. Monolithic delay line inductors and capacitors were used to match the diode chip to the transition as taught by related U.S. patent application Ser. No. 12/172,481; for this particular design the series delay line were 0.06 mm long, the parallel serpentine line had 0.02 mm ripples, and the parallel capacitor area was 0.055 mm×0.055 mm with a 1900 Å layer of SiN.

Figure 8:
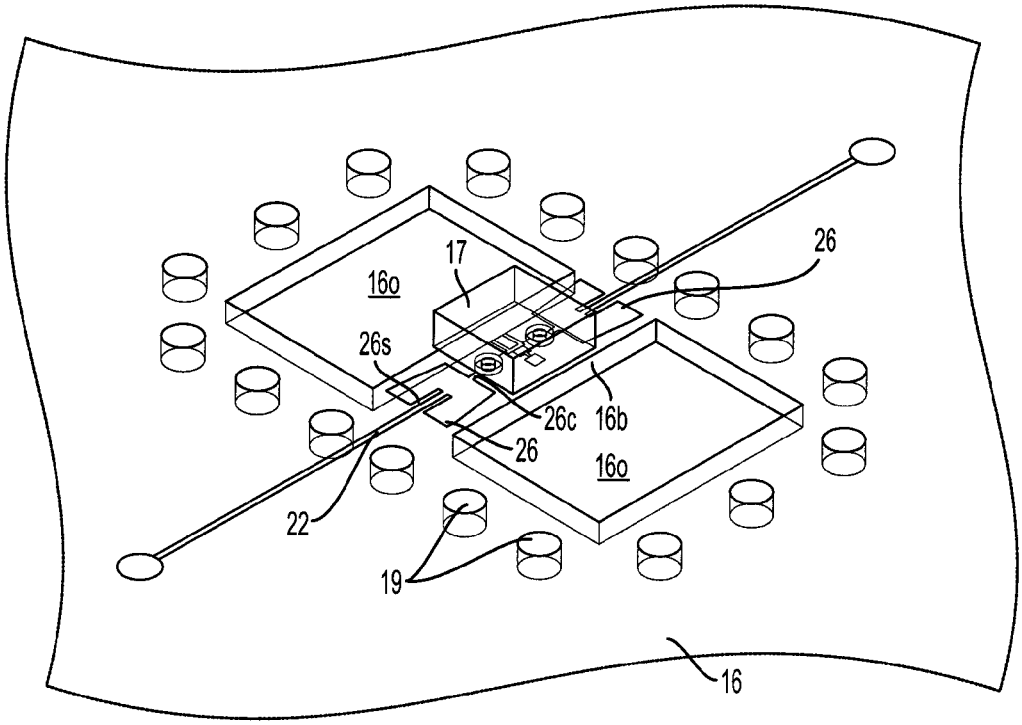
FIG. 8 is a perspective view of the substrate (and elements formed or mounted thereon) according to a second embodiment thereof.

Another embodiment of the wideband transition is fabricated with an alumina substrate 16 is shown in FIG. 8. In this embodiment, the transition uses an alumina substrate 16, preferably 0.1 mm thick, which substrate 16 has two openings 16*o* therein to account for the higher dielectric constant of alumina as compared to the fused silica shown in the embodiment of FIG. 4B. Electromagnetic simulation of the transition on a solid slab of alumina revealed spurious in-band resonances in the frequency dependent reflection coefficient. This was caused by the high dielectric constant of alumina, which is 9.8, that makes the substrate 16 appear electrically larger than that of the fused silica substrate 16 (which has a dielectric constant of 3.8) of the first described embodiment. This problem is solved in this latter embodiment by removing much of the alumina substrate 16 in way of the waveguide 14 of transition 10 using standard commercial processes, such as laser drilling (see, for example American Technical Ceramics "Thin Film Products Guideline," at www.atceramics.com/products/thinfilm.asp). Compare FIG. 8 with FIG. 4B noting the openings 16*o* which occur in the alumina embodiment of FIG. 8 and not the fused silica embodiment of FIG. 4B.

Figure 9A:
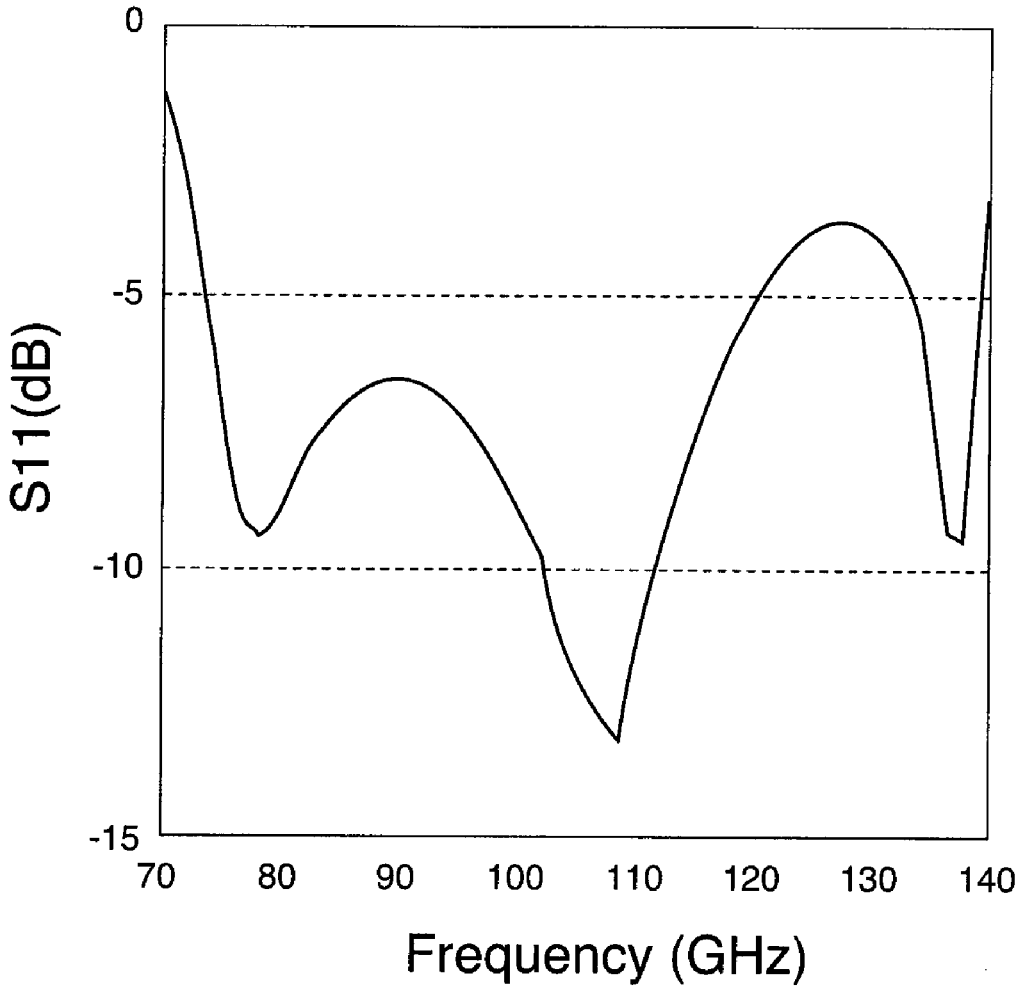
FIG. 9*a* is a graph of reflection from the transition looking in from the waveguide according to a simulation of the second embodiment.
Figure 9B:
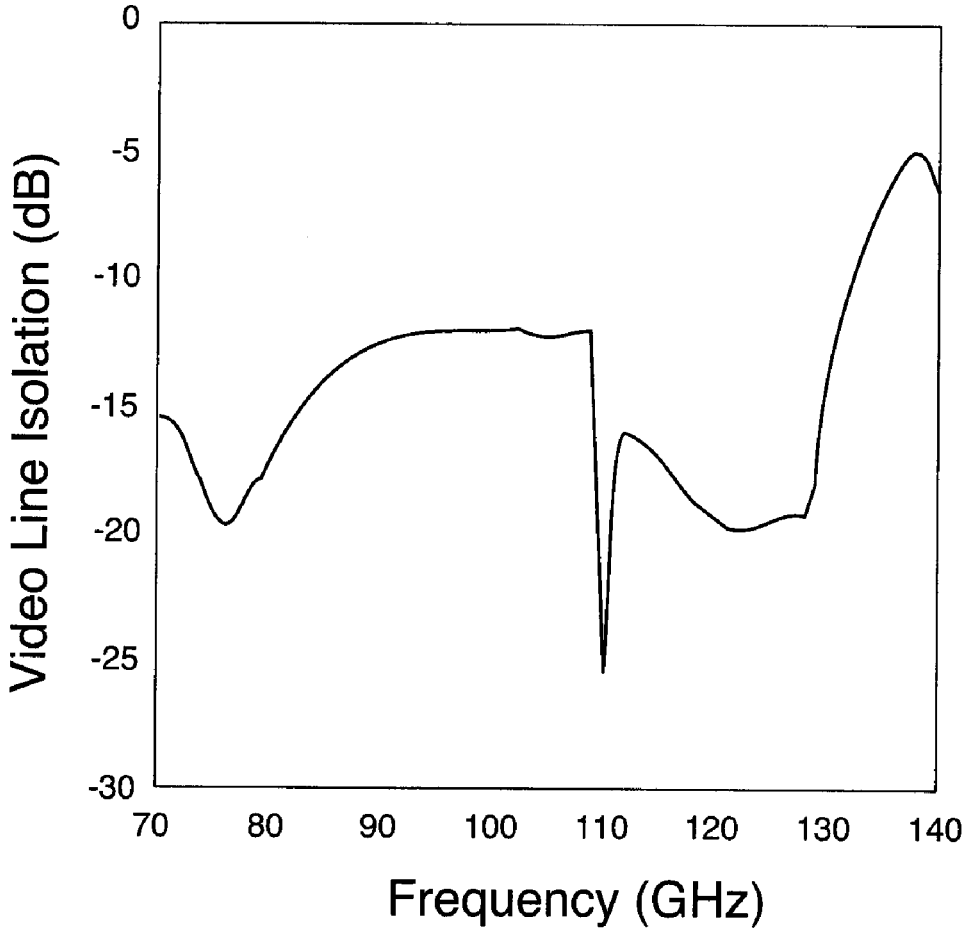
FIG. 9*b* is a graph of the RF isolation from the video output line according to a simulation of the second embodiment.

In FIG. 8, the detector diode chip 17 and transition probes 26 are located on a bridge 16*b* of alumina, as shown in FIG. 8, which occurs between openings 16*o*. In this figure, the width of the bridge 16*b* is preferably 0.4 mm. The RF probe 26 dimensions are the same as for earlier fused silica embodiment, however, the slots 26*s* for the RF choke need not be as long because of the higher dielectric constant of alumina compared to fused silica. All other waveguide and cavity dimensions are preferably the same as in the earlier fused silica embodiment. The simulated reflection coefficient as seen from the ridged waveguide and video line RF isolation is shown in FIG. 9*a*. For this case the detector model was again the 0.8 μm×0.8 μm diode, with monolithic diode matching elements of 0.08 mm for the series delay line inductors, 0.02 mm for the parallel delay line inductors, and a capacitor size of 0.05 mm×0.05 mm. The −5 dB bandwidth is 45 GHz and the effective bandwidth is 62.4 GHz. FIG. 9*b* is a graph of the RF isolation from the video output line according to a computer simulation of this second embodiment.

The openings 16*o* in the embodiment of FIG. 8 are depicted as being rectangular, but any convenient and preferably geometric shape will likely serve the intended purpose of reducing the bulk dielectric constant of substrate 16.

It should be understood that the above-described embodiments are merely some possible examples of implementations of the presently disclosed technology, set forth for a clearer understanding of the principles of this disclosure. Many variations and modifications may be made to the above-described embodiments of the invention without departing substantially from the principles of the invention. All such modifications and variations are intended to be included herein within the scope of this disclosure and the present invention and protected by the following claims.

What is claimed is:

1. A transition for coupling a horn antenna to a matched diode detector comprising:

a. a ridged waveguide operatively coupled to the horn antenna;

b. a substrate for supporting a diode chip, carrying said matched diode detector, adjacent said waveguide, the substrate also supporting a pair of RF pick-up probes, each RF probe having a portion which is coupled with the diode detector chip, the substrate also supporting conductors coupled to said diode chip and to said pair of RF pick-up probes; and c. a waveguide short circuit at least partially enclosing the diode chip and disposed adjacent said substrate.

2. The transition of claim 1 wherein each RF pick-up probe has a trapezoidal configuration at least partially penetrated by a slot for forming a shorted, slotted transmission line that serves as an RF choke between said diode chip and said conductors for carrying signals from said diode chip externally of said transition element, the trapezoidal configuration having a narrower end confronting an exterior wall of said diode chip.

3. The transition of claim 2 wherein the ridged waveguide assumes, in cross-section, a figure eight configuration.

4. The transition of claim 3 wherein the substrate is a dielectric material and therein the diode chip is supported by said substrate in a center of a throat of said waveguide.

5. The transition of claim 4 wherein the RF pick-up probes have first portions thereof which extend into the throat of said waveguide and second portions thereof which do not extend into the throat of said waveguide.

6. The transition of claim 5 wherein said substrate has a plurality of metal filled vias therein, the plurality of metal filled vias surrounding a projection of the ridged waveguide into said substrate.

7. The transition of claim 6 wherein said waveguide and said horn antenna are formed from a first common block of electrically conductive material and the waveguide short circuit is formed from a second common block of electrically conductive material, the second first common block of electrically conductive material having a cavity therein for receiving the diode chip, the first and second common blocks of electrically conductive material being disposed on opposing sides of said substrate so as to align said ridged waveguide, said diode chip and said waveguide short circuit along a common axis extending parallel to elongated ridges of said ridged waveguide.

8. The transition of claim 1 wherein said waveguide and said horn antenna are formed from a first common block of electrically conductive material and the waveguide short circuit is formed from a second common block of electrically conductive material, the second common block of electrically conductive material having a cavity therein for receiving the diode chip, the first and second common blocks of electrically conductive material being disposed on opposing sides of said substrate.

9. An antenna structure comprising a plurality of transitions according to claim 1 arranged in a planar two dimensional array of said transitions, the horn antennas associated with said plurality of transitions being arranged a planar two dimensional array of said horn antennas disposed immediately adjacent the planar two dimensional array of said plurality of transitions.

10. In combination, a RF pick-up probe, a RF choke, a diode RF detector and a DC output line, all electrically coupled with each other, and with at least the diode RF pick-up probe being disposed in a waveguide, the RF pick-up probe, in use, receiving RF radiation via said waveguide, and wherein said DC output line, in use, provides a detected DC voltage provided by the diode RF detector to one or more output lines.

11. The combination of claim 10 wherein the diode detector is disposed on a dielectric substrate disposed orthogonally to a major axis of said waveguide, the diode detector being at least partially enclosed by a RF short circuit provided by a cavity in an electrically conductive block disposed adjacent said dielectric substrate.

12. The combination of claim 11 wherein the one or more output lines are disposed on said substrate adjacent one or more channels formed in said electrically conductive block disposed adjacent said dielectric substrate.

13. The combination of claim 12 in further combination with a horn antenna operatively coupled with said waveguide.

14. The combination of claim 13 wherein the waveguide, in cross section, has a figure eight configuration.

15. The combination of claim 13 wherein the electrically conductive block and the horn antenna are each disposed immediately adjacent the dielectric substrate and wherein the dielectric substrate has a plurality of conductive vias disposed therein for ohmically coupling the electrically conductive block and the horn antenna together.

16. A transition for coupling a horn antenna to a matched diode detector, the transition comprising:

a. a ridged waveguide operatively coupled to the horn antenna;

b. a substrate for supporting said matched diode detector adjacent said ridged waveguide, the substrate also supporting a pair of RF pick-up probes, each RF probe having a portion which is coupled with said matched diode detector; and c. a waveguide short circuit at least partially enclosing the matched diode detector.

17. The transition of claim 16 wherein the matched diode detector is formed on a chip, said chip being disposed on said substrate.

18. The transition of claim 16 wherein the ridged waveguide has, in cross-section, a figure eight configuration.

19. The transition of claim 16 wherein the substrate is a dielectric material and therein the chip is supported by said substrate in a center of a throat of said waveguide.

20. The transition of claim 19 wherein the RF pick-up probes have first portions thereof which extend into the throat of said waveguide and second portions thereof which do not extend into the throat of said waveguide.

21. The transition of claim 16 wherein said substrate has a plurality of metal filled vias therein, the plurality of metal filled vias surrounding a projection of the ridged waveguide into said substrate.

22. The transition of claim 16 wherein said waveguide and said horn antenna are formed from a first common block of electrically conductive material and the waveguide short circuit is formed from a second common block of electrically conductive material, the second common block of electrically conductive material having a cavity therein for receiving the diode chip, the first and second common blocks of electrically conductive material being disposed on opposing sides of said substrate.

* * * * *